US006039424A

United States Patent [19]

Pink

[11] Patent Number: 6,039,424

[45] **Date of Patent: *Mar. 21, 2000**

[54] MULTIPLE HEIGHT PACKAGE RETAINER

[75] Inventor: John J. Pink, Cedar Rapids, Iowa

[73] Assignee: Amana Company, L.P., Amana, Iowa

[ * ] Notice: This patent issued on a continued prosecution application filed under 37 CFR 1.53(d), and is subject to the twenty year patent term provisions of 35 U.S.C. 154(a)(2).

[21] Appl. No.: 08/859,977

[22] Filed: May 21, 1997

[51] Int. Cl.[7] ..... A47B 96/04; A47F 5/00

[52] U.S. Cl. ..... 312/405.1; 211/88.01

[58] Field of Search ..... 312/405.1, 401, 312/404, 405, 408, 410, 321.5, 116, 183; 211/88.01, 90.01, 184, 106

[56] References Cited

U.S. PATENT DOCUMENTS

| | | | |
|---|---|---|---|
| 2,122,336 | 6/1938 | Berry | 211/88.01 |
| 3,982,798 | 9/1976 | Fellwock et al. | 312/405.1 X |
| 4,346,806 | 8/1982 | Bustos | 211/184 X |
| 4,560,072 | 12/1985 | Bunnell | 211/88.01 X |
| 4,840,279 | 6/1989 | Cobb et al. | 211/88.01 |
| 4,867,318 | 9/1989 | Robson | 211/184 X |
| 5,450,968 | 9/1995 | Bustos | 211/184 X |
| 5,567,029 | 10/1996 | Haenisch et al. | 312/405.1 |
| 5,685,624 | 11/1997 | Lee | 312/405.1 |
| 5,779,331 | 7/1998 | Fox et al. | 312/183 X |

FOREIGN PATENT DOCUMENTS

| | | | |
|---|---|---|---|
| 201307 | 4/1956 | Australia | 312/405.1 |
| 453976 | 1/1949 | Canada | 312/405.1 |

*Primary Examiner*—Peter M. Cuomo
*Assistant Examiner*—James O. Hansen
*Attorney, Agent, or Firm*—Tobor, Goldstein & Healey, L.L.P.

[57] ABSTRACT

A refrigerator door supports a shelf which has a shelf front. The shelf is arranged to support a package to be retained, and the shelf has first, second, third, and fourth holes. A wire is arranged to be inserted into the first and third holes so that the wire has a first height with respect to the shelf, and the wire is arranged to be inserted into the second and fourth holes so that the wire has a second height with respect to the shelf. The first and second heights are different so that the wire and the shelf front are able to retain packages of different heights.

19 Claims, 3 Drawing Sheets

FIG. 2
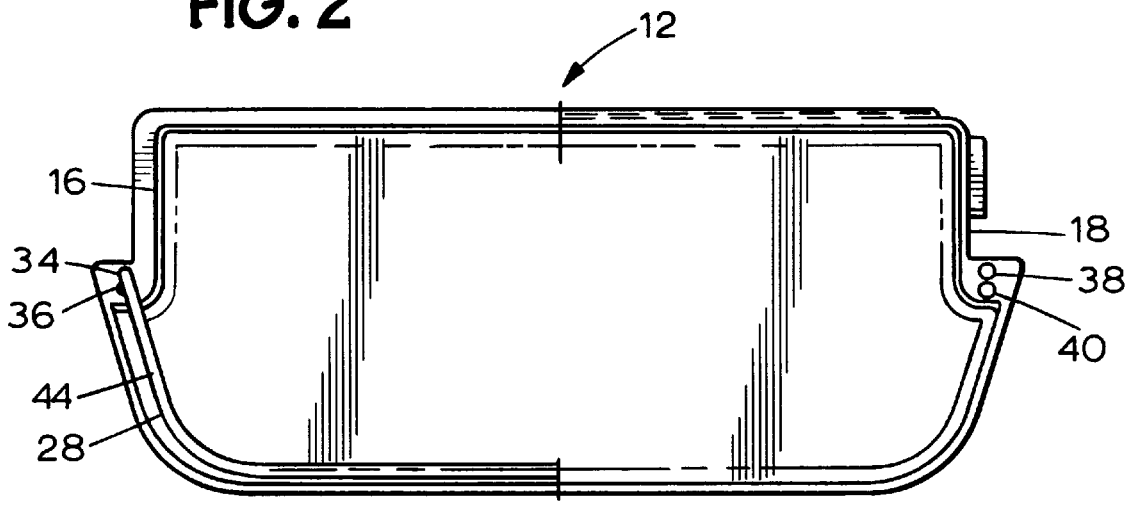
FIG. 3
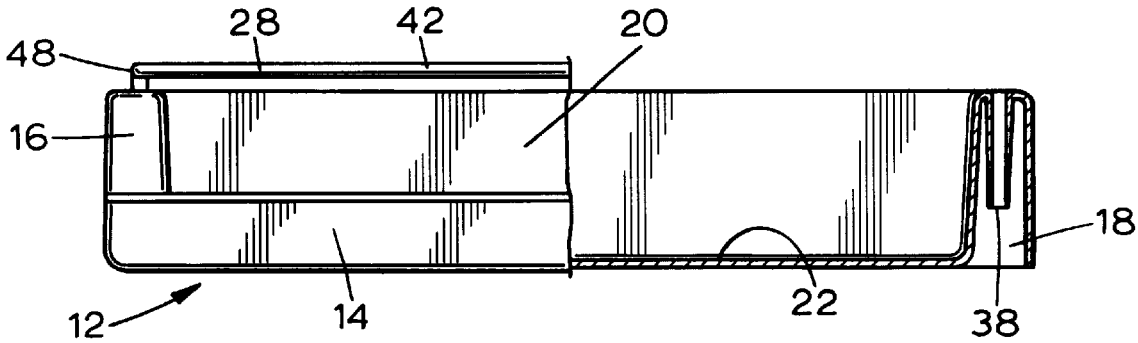
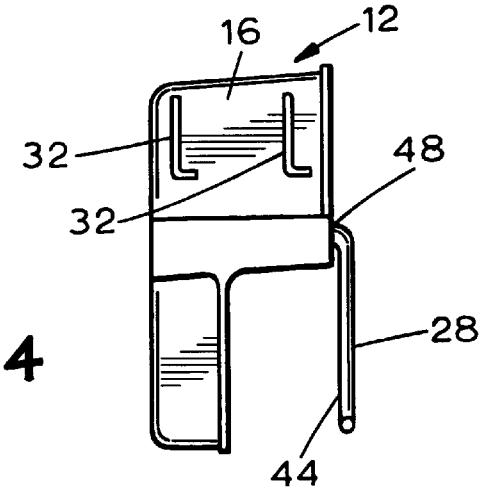
FIG. 4

MULTIPLE HEIGHT PACKAGE RETAINER

TECHNICAL FIELD OF THE INVENTION

The present invention relates to a multiple height package retainer and, more particularly, to a retainer which may be adjusted in order to retain packages of different heights in a door of a refrigerator or other appliance or cabinet.

BACKGROUND OF THE INVENTION

Refrigerator doors which fit over frozen and fresh food compartments typically include shelves on which additional food stuffs may be stored. Such shelves usually have front barriers which help retain food stuffs on the shelves, particularly as the refrigerator doors are opened and closed. The height of these barriers are fixed with respect to their shelves. That is, some shelves have higher barriers, and some shelves have shorter barriers.

Higher barriers better retain taller food stuffs on their corresponding shelves as refrigerator doors are opened and closed, but they make shorter food stuffs stored on these shelves more inaccessible. On the other hand, lower barriers permit easier access to shorter food stuffs, but inadequately retain taller food stuffs with centers of gravity that are above the tops of the lower barriers. Accordingly, taller foodstuffs should be stored on shelves having higher barriers, and shorter foodstuffs should be stored on shelves having lower barriers.

However, if a refrigerator door does not have a mix of shelves which matches the particular combination of taller and shorter foodstuffs to be stored thereon, taller foodstuffs may be stored on shelves having lower barriers and/or shorter foodstuffs may be stored on shelves having higher barriers. Accordingly, the taller food stuffs can tip around their higher centers of gravity and fall out of the shelves when the refrigerator door is opened and closed, and shorter foodstuffs may not be particularly accessible.

The present invention is directed to an arrangement which solves one or more of the above noted problems.

SUMMARY OF THE INVENTION

According to one aspect of the present invention, a shelf for a refrigerator door comprises a body and an adjustable height barrier. The body is arranged to support packages to be stored on a refrigerator door. The adjustable height barrier is arranged to cooperate with the body to retain packages supported by the body, and has first and second heights with respect to the body.

According to another aspect of the present invention, a multiple height package retainer comprises a body and a barrier. The body is arranged to receive a package to be retained, and the body has a first hole and a second hole. The barrier is arranged to be inserted into the first and second holes so as to have different package retaining heights with respect to the body.

According to yet another aspect of the present invention, a multiple height package retainer comprises a shelf and a barrier. The shelf has a shelf front, the shelf is arranged to support a package to be retained, and the shelf has a first hole and a second hole The barrier is arranged to be inserted into the first and second holes so as to have different package retaining heights with respect to the shelf, and the barrier is arranged to cooperate with the shelf front so as to retain packages.

According to still another aspect of the present invention, a refrigerator door comprises a shelf supporting means for supporting a shelf, a shelf supported by the shelf supporting means, and a barrier. The shelf has a shelf front, the shelf is arranged to support packages to be retained, and the shelf has a first hole and a second hole. The barrier is arranged to be inserted into the first and second holes so as to have different package retaining heights with respect to the shelf, and the barrier is arranged to cooperate with the shelf front so as to retain packages on the shelf.

BRIEF DESCRIPTION OF THE DRAWINGS

These and other features and advantages of the present invention will become more apparent from a detailed consideration of the invention when taken in conjunction with the drawing in which:

FIG. 2 is a top view of the retainer shown in FIG. 1;

FIG. 3 is a partial cross-sectional front view of the retainer shown in FIG. 1;

FIG. 4 is a side view of the retainer shown in FIG. 1;

DETAILED DESCRIPTION

Figure 1:
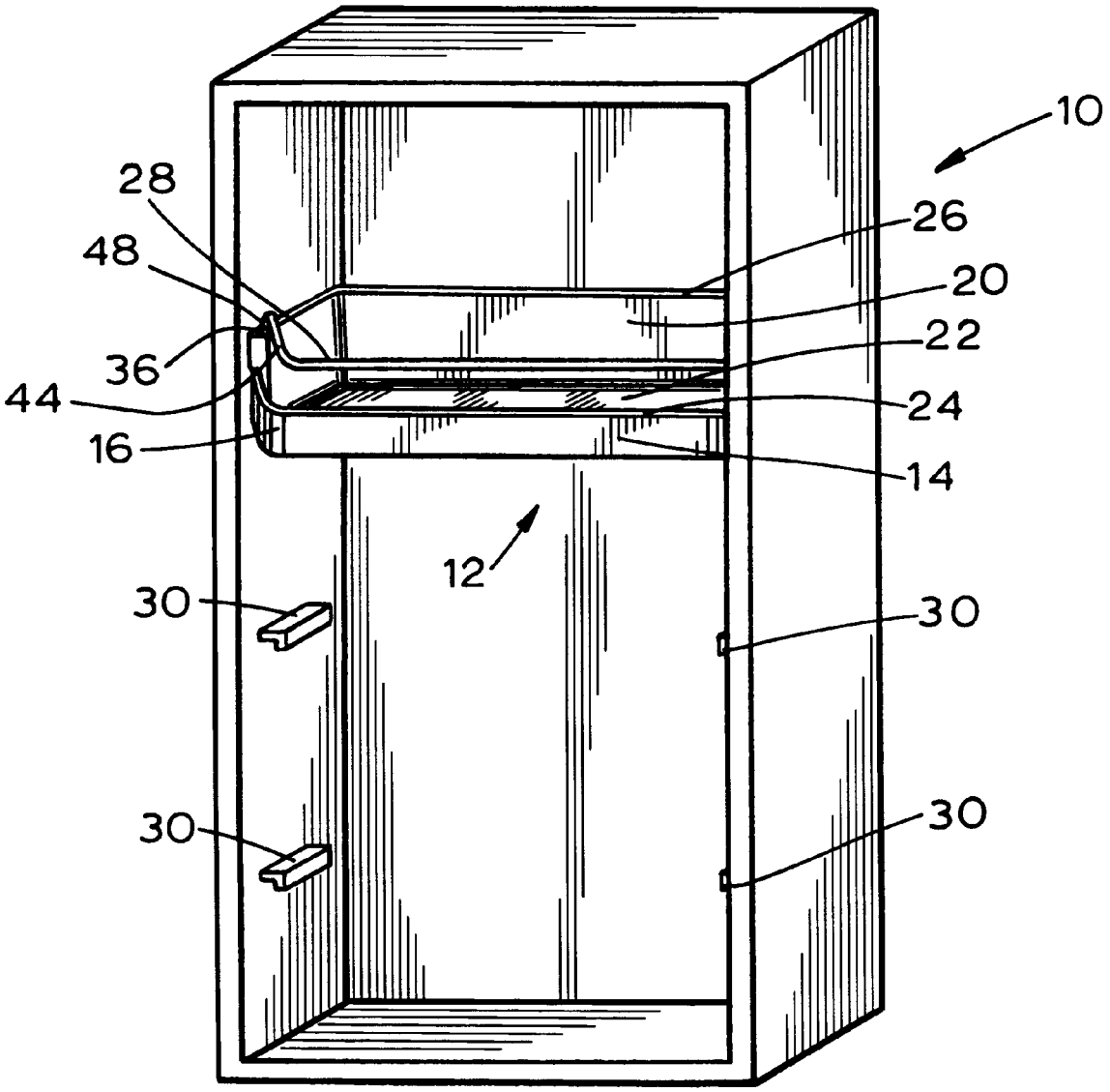
FIG. 1 is an isometric view of a refrigerator door having a retainer according to the present invention.

As shown in FIG. 1, a refrigerator door 10 supports a retainer, which may be in the form of a shelf 12. The shelf 12 includes a shelf front 14, a first shelf side 16, a second shelf side 18 (not shown in FIG. 1), a shelf back 20, and a shelf floor 22. The shelf front 14, the first shelf sides 16, the second shelf side 18, the shelf back 20, and/or the shelf floor 22 form a shelf body. The shelf front 14 has a front top surface 24 which, as shown in FIG. 1, is closer to the shelf floor 22 than is a back top surface 26 of the shelf back 20. However, the front top surface 24 need not be closer to the shelf floor 22 than is the back top surface 26. Instead, the front top surface 24 may be higher above the shelf floor 22 than is the back top surface 26, or the front top surface 24 and the back top surface 26 may be the same distance above the shelf floor 22.

A barrier 28, such as a wire barrier, is inserted through a pair of holes in the shelf 12 in order to retain food stuffs, which are stored on the shelf 12 and are supported by the shelf floor 22, as the refrigerator door 10 is opened and closed. The front top surface 24 is elevated above the shelf floor 22 in order to cooperate with the barrier 28 in the retention of the food stuffs that are placed on the shelf 12. The refrigerator door 10 includes shelf supports 30 which cooperate with corresponding repositioning supports 32 (FIGS. 4, 6, and 7) on the shelf 12 so that the shelf 12 can be vertically adjusted within the refrigerator door 10.

Figure 5:
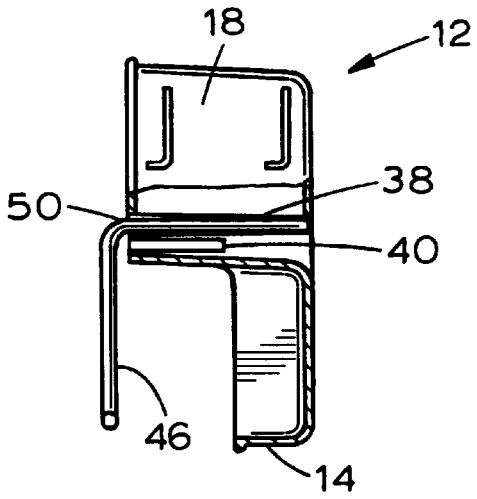
FIG. 5 is a cross-sectional side view of the retainer shown in FIG. 1; and, FIGS. 6 and 7, together with FIG. 5, illustrate adjustment of the retainer shown in FIG. 1.

The shelf 12 is shown more fully in FIGS. 2–5. A first hole 34 and a second hole 36 extend into, but not all the way through, the first shelf side 16. Similarly, a third hole 38 and a fourth hole 40 extend into, but not all the way through, the second shelf side 18. As shown in FIG. 5, the third hole 38 is formed more deeply into the second shelf side 18 than is the fourth hole 40. The first hole 34 has a depth into the first shelf side 16 which is commensurate with the depth of the third hole 38 into the second shelf side 18. Similarly, the second hole 36 has a depth into the first shelf side 16 which is commensurate with the depth of the fourth hole 40 into the second shelf side 18.

The barrier 28 has a middle section 42, a first end section 44, and a second end section 46. The first end section 44 has a first turned down end 48, and the second end section 46 has a second turned down end 50. The first turned down end 48 is arranged to fit into the first and second holes 34 and 36. Similarly, the second turned down end 50 is arranged to fit into the third and fourth holes 38 and 40.

Figure 6:
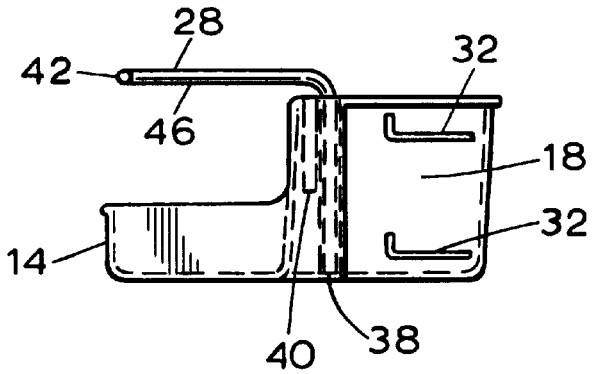

Accordingly, when shorter food stuffs are to be stored on the shelf 12, the first turned down end 48 of the barrier 28 is inserted into the first hole 34, and the second turned down end 50 of the barrier 28 is inserted into the third hole 38. Accordingly, the barrier 28 is in a first position which is shown in FIGS. 5 and 6. The shorter food stuffs may then be placed on the shelf floor 22 of the shelf 12 and are retained on the shelf 12 by the barrier 28 and the shelf front 14.

Figure 7:
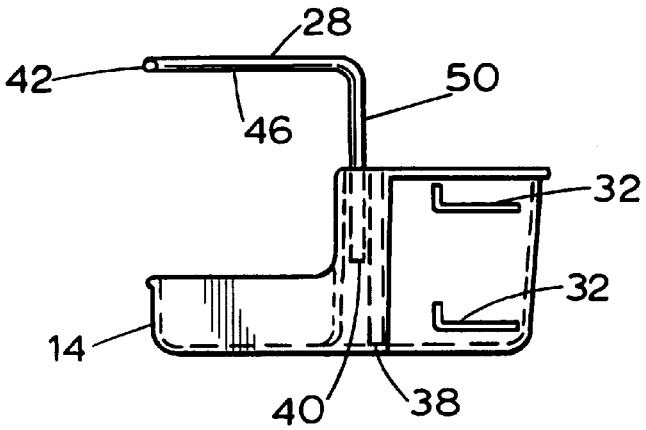

When taller food stuffs are to be stored on the shelf 12, the first turned down end 48 of the barrier 28 is removed from the first hole 34, and the second turned down end 50 of the barrier 28 is removed from the third hole 38. The first turned down end 48 of the barrier 28 is then inserted into the second hole 36, and the second turned down end 50 of the barrier 28 is inserted into the fourth hole 40. Accordingly, the barrier 28 is in a second position which is shown in FIGS. 5 and 7. Because the second and fourth holes 36 and 40 are not as deep as are the first and third holes 34 and 38, the barrier 28 is higher with respect to the shelf floor 22 of the shelf 12 in its second position than it is in its first position.

Thus, when the barrier 28 is in its second position, taller food stuffs may be stored on the shelf 12 with reduced likelihood of the taller food stuffs tipping off the shelf 12 as the refrigerator door 10 is opened and closed. When the barrier 28 is in its first position, shorter food stuffs may be stored on the shelf 12 so that the shorter food stuffs are easily accessible.

Certain modifications of the preset invention have been discussed above. Other modifications will occur to those practicing in the art of the preset invention. For example, the barrier 28 is described above as a wire barrier. Instead, the barrier 28 may be a bar, a slat, a molded or sculpted piece, or the like.

Moreover, the shelf floor 22 may be solid, a mesh, a plurality of parallel wires, or the like, and the shelf 12 may have a shape other than that shown in the drawings.

Furthermore, the depth of the first hole 34 need not be commensurate with the depth of the third hole 38, and the depth of the second hole 36 need not be commensurate with the depth of the fourth hole 40. Instead, the first and second turned down ends 48 and 50 of the barrier 28 may have different lengths in order to accommodate a depth of the first hole 34 which is different than a depth of the third hole 38 and a depth of the second hole 36 which is different than the depth of the fourth hole 40.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A multiple height package retainer for a refrigerator door, comprising:

a shelf having a shelf front, shelf floor, and first and second ends, the shelf being arranged to support at least one package to be retained;

a single barrier having first and second ends, the barrier being associated with the shelf and having first and second heights with respect to the shelf floor;

first and second holes disposed substantially perpendicular to the shelf floor at the first end of the shelf, the first and second holes each having a depth, the depth of the first and second holes being different, one of the holes receiving the first end of the barrier and, with the first end of the barrier being received within the first hole, the barrier has the first height, and with the first end of the barrier being received within the second hole, the barrier has the second height, the first height being less than the second height;

at least the first hole having a longitudinal axis the longitudinal axis being disposed substantially perpendicular to the shelf floor; and at least one hole at the second end of the shelf to receive the second end of the barrier.

2. The multiple height package retainer of claim 1, wherein the at least one hole is third and fourth holes disposed substantially perpendicular to the shelf floor at the second end of the shelf, the third and fourth holes each having a depth, the depth of the third and fourth holes being different, one of the third and fourth holes receiving the second end of the barrier, with the second end of the barrier being received within the third hole the barrier has the first height, and with the second end of the barrier being received within the fourth hole, the barrier has the second height, the first height being less than the second height.

3. The multiple height package retainer of claim 2 wherein the barrier is a wire having turned down ends, and wherein the turned down ends are arranged to be inserted into the first, second, third, and fourth holes.

4. The multiple height package retainer of claim 3 wherein the turned down ends comprise first and second turned down ends, wherein the first turned down end has a first length, wherein the second turned down end has a second length, and wherein the first and second lengths are approximately equal.

5. The multiple height package retainer of claim 2 wherein the barrier comprises first and second hole cooperating turned down ends, wherein the first hole cooperating turned down end has a first length, wherein the second hole cooperating turned down end has a second length, and wherein the first and second lengths are approximately equal.

6. The multiple height package retainer of claim 1 wherein the shelf has adjusting means for vertically adjusting the shelf.

7. The multiple height package retainer of claim 6 wherein the barrier is a wire having turned down ends, and wherein the turned down ends are arranged to be inserted into the first, second, third, and fourth holes.

8. The multiple height package retainer of claim 7 wherein the turned down ends comprise first and second turned down ends, wherein the first turned down end has a first length, wherein the second turned down end has a second length, and wherein the first and second lengths are approximately equal.

9. The multiple height package retainer of claim 6 wherein the barrier comprises first and second hole cooperating turned down ends, wherein the first hole cooperating turned down end has a first length, wherein the second hole cooperating turned down end has a second length, and wherein the first and second lengths are approximately equal.

10. The multiple height package retainer of claim 1 wherein the barrier comprises first and second hole cooperating projections, wherein the first hole cooperating projection has a first length, wherein the second hole cooperating projection has a second length, and wherein the first and second lengths are approximately equal.

11. A refrigerator door comprising:

shelf supporting means for supporting a shelf;

a shelf having a shelf front, shelf floor, and first and second ends, the shelf being arranged to support at least one package to be retained;

a single barrier having first and second ends, the barrier being associated with the shelf and having first and second heights with respect to the shelf floor;

first and second holes disposed substantially perpendicular to the shelf floor at the first end of the shelf, the first and second holes each having a depth, the depth of the first and second holes being different, one of the holes receiving the first end of the barrier and, with the first end of the barrier being received within the first hole, the barrier has the first height, and with the first end of the barrier being received within the second hole, the barrier has the second height, the first height being less than the second height; and at least one hole at the second end of the shelf to receive the second end of the barrier.

12. The refrigerator door of claim 11, wherein the at least one hole is third and fourth holes disposed substantially perpendicular to the shelf floor at the second end of the shelf, the third and fourth holes each having a depth, the depth of the third and fourth holes being different, one of the third and fourth holes receiving the second end of the barrier, with the second end of the barrier being received within the third hole the barrier has the first height, and with the second end of the barrier being received within the fourth hole, the barrier has the second height, the first height being less than the second height.

13. The refrigerator door of claim 12 wherein the barrier is a wire having turned down ends, and wherein the turned down ends are arranged to be inserted into the first, second, third, and fourth holes.

14. The refrigerator door of claim 13 wherein the turned down ends comprise first and second turned down ends, wherein the first turned down end has a first length, wherein the second turned down end has a second length, and wherein the first and second lengths are approximately equal.

15. The refrigerator door of claim 11 wherein the shelf has shelf adjusting means cooperating with the shelf supporting means for vertically adjusting the shelf with respect to the refrigerator door.

16. The refrigerator door of claim 15 wherein the barrier is a wire having turned down ends, and wherein the turned down ends are arranged to be inserted into the first, second, third, and fourth holes.

17. The refrigerator door of claim 16 wherein the turned down ends comprise first and second turned down ends, wherein the first turned down end has a first length, wherein the second turned down end has a second length, and wherein the first and second lengths are approximately equal.

18. The refrigerator door of claim 15 wherein the barrier comprises first and second hole cooperating turned down ends, wherein the first hole cooperating turned down end has a first length, wherein the second hole cooperating turned down end has a second length, and wherein the first and second lengths are approximately equal.

19. The refrigerator door of claim 11 wherein the barrier comprises first and second hole cooperating projections, wherein the first hole cooperating projection has a first length, wherein the second hole cooperating projection has a second length, and wherein the first and second lengths are approximately equal.

* * * * *